United States Patent [19]

Swift et al.

[11] 4,146,659

[45] Mar. 27, 1979

[54] FUSING TONER ON FUSER MEMBERS MADE OF NOBLE METALS AND ALLOYS THEREOF

[75] Inventors: Joseph A. Swift, Union Hill; Arthur C. Martellock, Pittsford, both of N.Y.

[73] Assignee: Xerox Corporation, Stamford, Conn.

[21] Appl. No.: 754,048

[22] Filed: Dec. 23, 1976

[51] Int. Cl.[2] ..... G03G 13/20

[52] U.S. Cl. ..... 427/194; 427/194; 427/375; 427/366; 148/6.24; 118/60; 118/653; 29/132; 219/216; 428/447

[58] Field of Search ..... 427/22, 135, 194, 375, 427/366; 148/6.24; 428/447

[56] References Cited

U.S. PATENT DOCUMENTS

| | | | |
|---|---|---|---|
| 4,011,362 | 3/1977 | Stewart | 427/388 D |
| 4,029,827 | 6/1977 | Imperial et al. | 427/22 |

*Primary Examiner*—Ralph S. Kendall

*Attorney, Agent, or Firm*—James J. Ralabate; Ernest F. Chapman

[57] ABSTRACT

Fuser members having surfaces of gold and the platinum groups metals and alloys thereof are described for fuser assemblies in office copier machines. Preferred fuser assemblies include cylindrical rolls having at least an outer surface of gold, a platinum group metal or alloys thereof. Electroscopic thermoplastic resin toner images are fused to a substrate by using a bare gold, a platinum group metal or alloys thereof fuser member coated with polymeric release agents having reactive functional groups for example, a mercapto-functional polysiloxane release fluid.

37 Claims, 2 Drawing Figures

FUSING TONER ON FUSER MEMBERS MADE OF NOBLE METALS AND ALLOYS THEREOF

BACKGROUND OF THE INVENTION

This invention relates generally to members utilized for fusing toners at elevated temperatures, and more particularly to rolls which will prevent offsetting of toner onto the roll during a pressure fusing operation at elevated temperatures.

In the process of xerography a light image of an original to be copied is typically recorded in the form of a latent electrostatic image upon a photosensitive member with subsequent rendering of the latent image visible by the application of electroscopic particles, commonly referred to as toner. The visual toner image can be either fixed directly upon the photosensitive member or transferred from the member to another support, such as a sheet of plain paper, with subsequent affixing of the image thereto. Toners are well known in the art and may be of various types.

In order to affix or fuse electroscopic toner material onto a support surface permanently by heat, it is necessary to elevate the temperature of the toner material to a point at which the constituents of the toner material coalesce and become tacky. This action causes the toner to flow to some extent into the fibers or pores of support members or otherwise upon the surface thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

Several approaches to thermal fusing of electroscopic toner images onto a support have been described in the prior art and include providing the concomitant application of heat and pressure as by a roll pair maintained in pressure contact, a flat or curved plate member in pressure contact with a roll, a belt member in pressure contact with a roll, and the like. Heat may be applied by heating one or both of the rolls, plate members or belt members. The fusing of the toner takes place when the proper combination of heat, pressure and contact time are provided, the balancing of these parameters being well known in the art and varying according to various factors which must be independently determined for each particular situation.

During operation of a fusing system of the type where there is a thermal fusing of electroscopic toner images onto a support in which at least one fuser member, such as a roll, plate or belt, is heated, the support member to which the toner images are electrostatically adhered, is moved through the nip formed between the members with the toner image pressure contacting the fuser roll thereby to effect heating of the toner images within the nip. By controlling the heat transfer to the toner, virtually no offset of the toner particles from the copy sheet to the fuser member is experienced under normal conditions. This is because the heat applied to the surface of the fuser member is insufficient to raise the temperature of the surface of the member above the "hot offset" temperature of the toner at which temperature the toner particles in the image areas of the toner liquify and cause a splitting in the molten toner resulting in "hot offset". Splitting occurs when the cohesive forces holding the viscous toner mass together is less than the adhesive forces tending to offset it to a contacting surface such as a fuser roll, fuser belt, or fuser plate.

Occasionally, however, toner particles will be offset to the fuser roll by an insufficient application of heat to the surface thereof (i.e. "cold" offsetting); by imperfection in the properties of the surface of the roll; by the toner particles insufficiently adhering to the copy sheet; by the electrostatic forces which normally hold them there; or by the reactivity of the toner material itself in those cases where the toner is of a reactive nature. In such a case, toner particles may be transferred to the surface of the fuser member with subsequent transfer to the backup member which provides pressure contact, during periods of time when no copy paper is in the nip.

One arrangement for minimizing the foregoing problems, particularly that which is commonly referred to as "offsetting", has been to provide a fuser member with an outer surface or covering of polytetrafluoroethylene, known by the trademane Teflon, to which a release agent such as silicone oil is applied. More reactly, bare metal fuser members have been introduced for fusing or fixing the electroscopic toner materials to various surfaces. Various fluid polymer release materials which oxidize or which contain functional groups can be utilized to prevent "offsetting". In accordance with the present invention these polymeric release fluids are defined as polymeric release fluids having fuctional groups or functional polymeric release fluids. Exemplary of such systems are those disclosed in U.S. Pat. No. 3,937,637 and U.S. No. Pat. 3,918,804. Other fluid release agents for bare metal fuser members are described in Belgian Pat. No. 831,662.

Typical materials heretofore proposed for bare metal fuser rolls include anodized aluminum and alloys thereof, steel stainless steel, nickel and alloys thereof, nickel plated copper chrome plated copper and glass. Generally, copper is considered superior as a bare metal fuser member material because it has desirable release characteristics when used with certain polymeric release fluids having functional groups, and it has excellent thermal conductivity. However, bare copper fuser rolls and the other enumerated bare metal fuser rolls are disadvantageous because of adverse effects of the metals upon the polymeric release agents having functional groups. During periods of standby and during operation, the conventional metal fuser rolls tend to promote the gelation and degradation of the polymeric release fluids having functional groups. This necessitates frequent replacement of the release fluid, and this is an uneconomical disadvantage because of replacement cost and machine down time.

OBJECTS OF THE INVENTION

Accordingly, it is the principal object of this invention to provide a fusing method and system which overcomes the foregoing disadvantages. It is another object of this invention to provide a new and improved bare metal fuser system for use in xerographic copying machines.

Another object of this invention is to provide a new and improved fusing method for fusing toner images on bare metal fuser members in xerographic copying machines.

Another object of this invention is to provide a fuser assembly having an improved bare metal fuser roll for use with polymer release materials which oxidize or which contain functional groups for the prevention of offsetting when the bare metal fuser roll is used to fuse xerographic toners to suitable substrates.

SUMMARY OF THE INVENTION

The above-cited objects of the present invention are accomplished by a bare gold, platinum group metal and/or alloys thereof fuser member for pressure fusing electrostatic toner images at elevated temperatures. It was unexpectedly found that when the surface of the fuser member is gold or rhodium and other platinum group metals, there is remarkable improvement in the stability and life of fluid polymer release materials having functional groups when these fluids are applied to the gold or rhodium or other platinum group metals or alloys thereof surface as a release agent for the toner being fused to a substrate in electrostatic copying devices.

The fuser member having improved life when used with polymeric release fluids having functional groups, comprise a base member having a bare metal working surface of gold or gold alloy or a platinum group metal or platinum group metal alloy surface; and a stable barrier layer intermediate the polymeric release fluid and the metal surface, the stable barrier layer comprising the chemical product resulting from the interaction of the polymeric release fluid having functional groups and the specified metal or metal alloy.

The foregoing fuser member offers a substantial improvement in the method of fusing electroscopic thermoplastic resin toner images to a substrate because of the stability of the barrier layer formed intermediate the working surface of the fuser member and the release layer of polymeric release fluid having functional groups and because of the increased life of the polymeric release material having functional groups when the release material is in the fuser assembly during standby condition. By standby condition is meant that period of time when a copying apparatus, and thus the fuser assembly, is in a condition of readiness awaiting operation. Thus, in the method of fusing electroscopic thermoplastic resin toner images to a fuser member in an electrostatic reproducing apparatus, said film being a barrier to the electroscopic thermoplastic resin toner and comprising the product resulting from the interaction of the fuser member and a polymeric release fluid having functional groups which interact with the fuser member, said polymer being fluid at the temperature of the fuser member and acting as a release fluid film for the toner; the toner image contacts the coated, heated fuser member for a period of time sufficient to soften the electroscopic thermoplastic resin toner; and the toner is cooled, in accordance with the present invention the improvement comprises providing a fuser member having a gold or gold alloy surface or a platinum group metal or platinum group metal alloy to which the polymeric release fluid having functional groups is applied.

Preferred fuser assemblies include cylindrical rolls, flat plates, curved plated, belts and the like having at least an outer surface of gold or gold alloy or platinum group metal or platinum group metal alloy. The specified alloys are those which in the presence of the polymer release fluids, namely those polymer release materials which oxidize or which contain functional groups, interact therewith when applied thereto as release fluids so that the essentially bare metal gold alloy or platinum group metal alloy can be used to fuse xerographic toners to suitable substrates.

In accordance with the present invention, a gold alloy or a platinum group metal alloy includes a solid mixture of gold or platinum group metal and one or more metals; gold or platinum group metal and one or more metals having certain non-metallic elements fused therein; the impregnation of at least one metal into the surface of gold or platinum group metal or vice versa, and the like. To form the gold or gold alloy or the platinum group metal or platinum group metal alloy at least upon the surface of the base member, the particular metal or metal alloy may be flame/plasma sprayed, electroplated, welded, a sleeve force fit upon a base member, electroless plated, and the like, and the base member itself may comprise the particular metal or metal alloy and under such circumstances the surface therof comprises the gold or gold alloy or the platinum group metal or platinum group metal alloy used in accordance with the present invention.

In accordance with the present invention, a barrier layer is formed upon the gold or gold alloy or platinum group metal or platinum group metal alloy surface when polymer release materials which oxidize or which contain functional groups, are placed upon the surface of the specified metal or metal alloy especially at operating temperatures. The metal or metal alloy interacts with the polymer release materials which oxidize or which contain functional groups. Operating temperatures are generally from about 200° F. to about 550° F.

As used herein metal or metal alloy or specified metal or metal alloy refer to gold or gold alloy or to a platinum group metal or a platinum group metal alloy. A platinum group metal is defined as platinum, rhodium, ruthenium, palladium, osmium and iridium and platinum group metal alloys refers to the alloys of the foregoing metals.

These as well as other objects of the invention and further features thereof will be better understood upon reference to the following detailed description of the invention wherein reference is made to the accompanying drawings.

DESCRIPTION OF THE PREFERRED EMBODIMENTS

Figure 1:
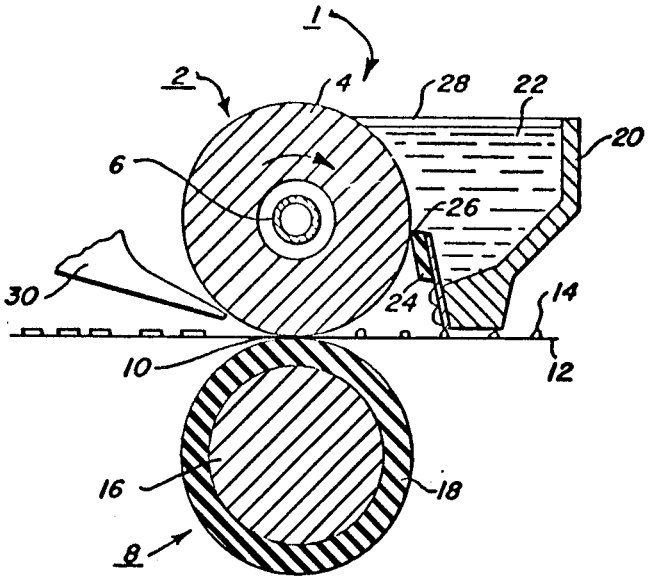
FIG. 1 is an outline elevational view of a fuser system for a xerographic reproducing apparatus.

The fuser embodiments of the present invention may be used in an automatic xerographic reproducing machine, such as for example, automatic xerographic reproducing machine described in U.S. Pat. No. 3,937,637, said patent being incorporated herein by reference. Therein is illustrated a reproducing machine which employs an image recording drum-like member, the outer periphery of which is coated with a suitable photoconductive material. One type of photoconductive material is disclosed in U.S. Pat. No. 2,970,906 issued to Bixby in 1961. The photoconductive drum is suitably journaled for rotation within a machine frame by means of a shaft which rotates to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well-known in the art, the various processing stations for producing a copy of an original are represented as stations A to E. Initially, the drum moves the photoconductive surface through a charging station A. At charging station A an electrostatic charge is placed uniformly over the photoconductive surface of the drum preparatory to imaging. The charging may be provided by a corona generating device of a type described in U.S. Pat. No. 2,836,725 issued to Vyverberg in 1958.

Thereafter, the drum is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure the photoconductive drum rotates the electrostatic latent image recorded on the photoconductive surface to development station C, wherein a conventional developer mix is applied to the photoconductive surface rendering the latent image visible. A suitable development station may include a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on the photoconductive surface is developed by bringing the brush of the developer mix into contact therewith. The developed image on the photoconductive surface is then brought into contact with a sheet of final support material within a transfer station D and the toner image is transferred from the photoconductive surface to the contacting side of a final support sheet. The final support material may be plain paper, gummed labels, transparencies such as polycarbonate, polysulfone and Mylar, etc., as desired. Mylar is a trademark of E.I. du Pont Nemours & Company.

After the toner image has been transferred to the sheet of final support material, the sheet with the image thereon is advanced to a suitable fuser assembly which fuses the transfer powder image thereto. After the fusing process, the final support material is advanced by a series of rolls to a copy paper tray for subsequent removal therefrom by a machine operator.

Although most of the toner powder is transferred to the final support material, some residual toner remains on the photoconductive surface after the transfer of the toner powder image to the final support material. The residual toner particles remaining on the photoconductive surface after the transfer operation are removed from the drum as it moves through cleaning station E. Here the residual toner particles may first be brought under the influence of a cleaning corona generating device adapted to neutralize the electrostatic charge remaining on the toner particles. The neutralized toner particles are then mechanically cleaned from the photoconductive surface by conventional means as for example, the use of a resiliently biased knife blade. Other cleaning modes may be used at cleaning station E as desired by one skilled in the art.

It is believed that the foregoing description is sufficient for purposes of present application to illustrate the general operation of an automatic xerographic copier which can embody the teachings of the present invention.

As discussed above, fuser assemblies include cylindrical rolls, flat plates, curved plated, belts and the like having at least an outer surface of gold or gold alloy or platinum group metal or platinum group metal alloy, however, for ease of description and applicable to all fuser members, emphasis herein is directed to a fuser assembly having a roll structure as a fuser member. The method of providing the necessary heat is not critical in the use of the specified metal or metal alloy fusers of this invention and the fuser members can be heated by internal means, external means or both all heating means being well-known in the art for providing sufficient heat to fuse toner to its substrate.

A preferred fuser assembly comprises a heated roll structure as described in U.S. Pat. No. 3,937,637 issued to Moser and Ruhland. The heated roll structure includes a hollow cylinder or core having a suitable heating element disposed in the hollow portion thereof which is coextensive with the cylinder. The heating element may comprise any suitable type heater for elevating the surface temperature of the cylinder to operational temperatures therefor, for example about 200°-400° F. A preferred heating element is a quartz lamp. It is critical that the cylinder surface be fabricated from gold or gold alloy or platinum group metal or platinum group metal alloy, and that the polymeric release material having functional groups form a stable interfacial barrier layer with the particular metal or metal alloy by chemical interaction therewith, especially at operating temperatures. Any substrate may be used as a core to support the outer surface of gold or gold alloy or platinum group metal or platinum group metal alloy, as long as the specified metal or metal alloy is suitably affixed thereto and can withstand the pressures, heat and other rigorous conditions concomitant in the operation of the fuser assembly. For example, the core or base member may be steel, stainless steel, copper, nickel, aluminum and the like or the core or base member can be made of the specified metal or metal alloy itself or a combination thereof.

The fuser assembly may further comprise a backup member such as a belt or roll structure which cooperates with the fuser roll structure. The backup member may comprise any suitable construction, for example, a steel cylinder, but preferably comprises a rigid steel core having an elastomer surface or layer thereon, or it may be a suitable belt material which provides the necessary contact between the fuser member and the substrate carrying the developed latent image. The dimensions of the fuser member and backup member may be determined by one skilled in the art and generally are dictated by the requirements of the particular copying apparatus in which the fuser assembly is employed, the dimensions being dependent upon the process speed and other parameters of the machines. Means may also be provided for applying a loading force in a conventional manner to the fuser assembly to create nip pressure on the order of about 15 to 150 psi average or higher as desired.

The fuser member treated by the method of the present invention wherein at least one of the designated polymeric release fluids having functional groups is applied to the specified metal or metal alloy surface of the fuser member, said fluid being capable of interacting with the specified metal or metal alloy of the fuser member surface to form an unexpectedly stable interfacial barrier layer and being applied in an amount sufficient to cover the surface with at least a continuous, low surface energy film of the fluid to prevent the toner from contacting the surface of the fuser member and to provide a surface which releases the toner heated by the fuser member, is illustrated in the fuser assembly shown in FIG. 1.

FIG. 1 is meant to be exemplary only, the invention being applicable to any fuser assembly in which the fuser member is heated and a release agent is applied thereto. In FIG. 1, the numeral 1 designates a fuser assembly comprising heated roll structure 2, backup roll 8 and sump 20. Heated roll 2 includes a hollow cylinder 4 having a suitable heating element 6 disposed in a portion thereof which is coextensive with the cylinder.

Backup roll 8 cooperates with roll structure 2 to form a nip 10 through which a copy paper or substrate 12 passes such that toner images 14 thereon contact heated roll 2. As shown in FIG. 1, the backup roll 8 has a rigid steel core 16 with an elastomer surface or layer 18 thereon.

Cylinder 4 is fabricated of gold or gold alloy or plastinum group metal or platinum group metal alloy or said specified metal or metal alloy coated upon a metal substrate, such as anodized aluminum, aluminum and alloys thereof, steel, nickel and alloys thereof, copper and the like as described above or glass. The gold or gold alloy or platinum group metal or platinum group metal alloy has a relatively high surface energy, and consequently toner material 14 contacting such surfaces when they are heated, would readily wet the surface. Accordingly, there is provided in accordance with the embodiment of FIG. 1, sump 20 containing at least one of the designated release agents 22 (polymeric release fluids) capable of displacing electroscopic thermoplastic resin toner when the agent is in a fluid state, the polymeric release fluid being capable of interacting with the fuser member surface to form a stable interfacial barrier layer thereon when in a fluid state. The release material 22 may be a solid or liquid at room temperature, but it must be a fluid at operating temperature preferably having a relatively low viscosity at the operating temperatures of heated roll 2.

In the embodiment shown in FIG. 1 for applying release /materail 22 to the surface of heated roll 2, a metering blade 24 preferably of conventional non-swelling rubber is mounted to sump 20 by conventional means such that an edge 26 thereof contacts the gold or gold alloy or platinum group metal or platinum group metal alloy surface 2 of the fuser roll structure to serve as a metering means for applying release material 22 to the fuser roll in its liquid or fluid state. By using such a metering blade, a layer of release fluid 22 can be applied to the specified metal or metal alloy surface of heated roll 2 in controlled thicknesses ranging from submicron thickness to thicknesses of several microns of the release fluid. Thus, by metering device 24, about 0.1 to 0.5 micron or greater thicknesses of release fluid can be applied to substrate 2 as desired. In the embodiment shown, a pair of end seals 28, for example, of sponge rubber, are provided to contain the release material 22 in sump 20. One or more stripper fingers 30 may be provided for insuring removal of the substrate 12 from substrate 2. In one of the preferred embodiments, the thermoplastic resin toner may be fused to other substrates such as polymeric films by the fuser members and process of the present invention, the only limitation being that the polymeric release fluids must not adversely react with the substrate upon which the toner is used and must not destroy or alter the coloring properties of the thermoplastic resin toner.

The embodiment described above in FIG. 1 is merely one of the preferred means for applying a layer of the described polymer release materials having functional groups capable of interacting with the gold or gold alloy or platinum group metal or platinum group metal alloy fuser member surface to form a remarkably stable interfacial barrier layer in an amount sufficient to cover the surface with at least a continuous, low surface energy film of the fluid to provide the fuser member with a surface which releases thermoplastic resin toner heated by the fuser member. Other means for applying the release fluid which is abhesive to electroscopic thermoplastic resin toner comprise means which spray a layer of the release fluid upon the fuser surface, a pad or sponge-like material which pads a coating of the release fluid on the surface of the fuser member, a wick which contacts the surface of the fuser member to provide a film or layer of the release material, extruding means which extrude a minute film of the release material on the fuser member, a brush having fibers or bristle having the release fluid on the surfaces of the bristles or brush materials, fluid soaked rolls, fluid donor rolls or betts, sponges or wicks and the like.

Figure 2:
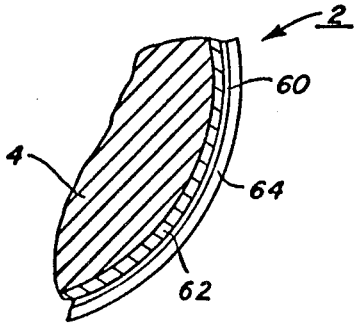
FIG. 2 is an enlarged fragmentary view of a gold plated fuser member of the present invention.

The fuser member for an electrostatic reproducing apparatus resulting from the method of treating the surface of a heated fuser member with at least one polymeric release mercapto-functional fluid having functional groups, for example, mercapto-functional polyalkylsiloxane fluid, capable of displacing electroscopic thermoplastic resin toner, is shown in FIG. 2. The fuser member shown FIG. 2 is magnified many times over the member shown in FIG. 1 in order to show the thin layers on the fuser member surface. In FIG. 2, the core portion of the heated roll is designated by numeral 4. A layer of gold plated upon core 4 is designated by numeral 62. A release layer of fluid is designated by numeral 64, and an interfacial barrier layer is designated by numeral 60. Thus, there is described a fuser member having a core portion 4, a plated gold layer 62, a release layer of polymer fluid having functional groups, for example, mercapto-functional polyalkylsiloxane fluid 64, which is abhesive to electroscopic toner, and interfacial barrier layer 60 which is formed by the interaction of gold layer 62 and polymeric release fluid layer 64 at elevated temperatures.

While the mechanism is not completely understood, it has been observed that when these classes of polymer release fluids having functional groups or which oxidize to form functional groups on the polymer, are applied to the gold or gold alloy or platinum group metal or platinum group metal alloy surface of the fuser device, there is an interaction (a chemical reaction, a coordination complex, a thermal oxidative decomposition or other mechanism) between the specified metal or metal alloy surface of the fuser and the polymer, so that an interfacial barrier layer comprising the reaction product between the specified metal or metal alloy of the fuser member and the polymer having functional groups is formed intermediate the specified metal or metal alloy of the fuser member and the outer layer of polymer release fluid coating the fuser member. This outer layer may be referred to as the non-reacted or virgin release layer, or generally, the release layer. The coating, however formed, has been observed to have a greater affinity for the fuser substrate material than the toner and thereby prevents electroscopic thermoplastic resin toners from contacting the core, while the release coating provides a material the cohesive force of which is less than the adhesive forces between the heated toner and the substrate to which it is applied, and the cohesive forces of the toner. Not only do these coatings have excellent release properties, but is been observed that the thermally-stable barrier layer is continuously renewable and self-repairing, and when the metal of the fuser member surface is gold or gold alloy or platinum group metal or platinum group metal alloy, the barrier layer is remarkably stable. Furthermore, if this coating is damaged, for example, by uneven pressures exerted by the blade uitlized for metering the release material on the specified metal or metal alloy surface by the abrasive effect of paper, or by undue forces exerted by the finger employed for stripping the substrate from the fuser roll structure, the thermally-stable coating will repair itself.

The polymeric fluid release materials are well-known in the art and includes the polymer release materials which oxidize and react with the specified metal or metal alloy surface of the fuser member, exemplary of which are those described in U.S. Pat. No. 3,937,637, for example polyethylene, polypropylene and the like. Other fluid polymer release materials include those which have reactive functionality and react with the specified metal or metal alloy of the working surface of the fuser member. Typical of these polymer release materials which have reactive functionality are the polyorganosiloxanes having functional carboxy groups as described in U.S. Ser. No. 491,432, filed July 24, 1974, now abandoned polyorganosiloxanes having functional mercapto groups as described in U.S. Ser. No. 491,412 filed July 24, 1974 now U.S. Pat. No. 4,029,827 and other polymer fluids as described in U.S. Ser. No. 491,415, filed July 24, 1974, all assigned to the instant assignee and incorporated herein by reference.

Examples of polymeric release materials having functional groups include mercapto-functional polyalkylsiloxanes, such as a gamma-mercapto propyl polydimethylsiloxane, carboxyfunctional substituted polydimethylsiloxane, mercapto-functional polyethylene, and the like as described in the foregoing references. A preferred class of polymeric fluids useful with the fuser member having a specified metal or metal alloy surface is a polysiloxane of the dialkyl type having the general formula:

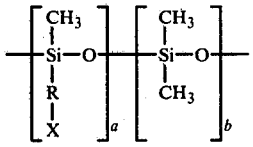

wherein R represents a spacer group pendant from the polymer backbone and X represents a mercapto (—SH) functional group. In preferred embodiments R is an alkyl moiety having about 1–8 carbon atoms, typically a propyl group ($—CH_2—CH_2—CH_2—$). These polymers may be diluted or cut by the addition of miscible, nonfunctional materials, for example, silicone oil. For a typical polymer having a one mole percent functional content there is 1 a moiety for every 99 b moieties. A typical polysiloxane has a molecular weight (weight average) of about 10,000 to about 30,000. In the foregoing disclosures the referenced polymer materials having designated functional groups are applied to a heated fuser member in an electrostatic reproducing apparatus to form thereon a thermally-stable renewable, self-cleaning layer having excellent toner release properties for electroscopic thermoplastic resin toners. The polyorganosiloxane fluids and other polymeric fluids having functional groups interact with the metal fuser member in such a manner as to form an interfacial barrier at the specified metal or metal alloy surface of the bare metal fuser member while leaving an unreacted low surface energy release fluid as an outer layer of film. The intefacial barrier is strongly attached to the bare gold or gold alloy or platinum group metal or platinum group metal alloy fuser member surface and prevents toner material from contacting the outer surface of the fuser member. The material on the surface of the fuser member can be a minimal thickness and thereby represent a minimal thermal barrier.

As used herein, "working surface" of the fuser member, is that surface which contacts the toner to cause the toner to fuse to the substrate upon which it is to be affixed permanently, for example, paper. Thus, the specified metal or metal alloy surface of the fuser member is the "working surface". As used herein, that characteristic of the polymer release material applied to the bare metal or metal alloy working surface of the fuser member and designated as "reactive functionality" is defined in the foregoing disclosures, and encompasses those polymers which either oxidize and thereby form a functional group which reacts with the fuser member surface to form the desired toner release layer, or have a built-in functional group or groups which react with the fuser member surface to form the desired toner release layer.

Not only do gold or gold alloy or platinum group metal or platinum group metal alloy provide superior fuser member working surfaces because they have substantially improved interfacial barrier layer formation over copper, but they also have excellent release characteristics and are able to withstand repeated standby periods without deteriorating or gelling the polymer release fluids when the specified metal or metal alloys are used as working surfaces on fuser members. By "release characteristics" is meant the ability to release heated ormolten toner from the surface of the fuser member to thereby prevent hot offset, a characteristic failure of fuser members well-known in the art. For example, hot offset tests are performed by visually determining if the toner image is transferred from the substrate to which it is to be fused, to the fuser member itself, or to the next substrate passing through the fuser member, or to the pressure or backup member or roll, or any combination of the foregoing.

Release failure is related to the splitting of the image when the toner is softened and becomes sufficiently sticky to adhere to the surface of the fuser member which results in a partial or ghost image on the fuser member, the next sheet or the pressure roll, producing what is referred to as an offset image. Therefore, the release property is a function of the offset image, and the higher the temperature of the fuser member before hot offsetting occurs, the better the release properties of the particular mode. Furthermore, the greater fusing latitude, that is the temperature at which the toner begins to fuse up to the temperature where hot offset begins to occur, is also known as the fusing window of the fuser member.

Generally, it is preferred to use the gold or gold alloy or platinum group metal or platinum group metal alloy only on the surface of the fuser member to avoid excessive expense. However, in those modes where maximum thermal conductivity is required in the fuser member, the base element of the fuser member, that is the core, is preferably made of a material which has high thermal conductivity such as copper, aluminum and the like. In these modes a sheath of the gold or gold alloy or platinum group metal or platinum group metal alloy can be placed over the base member to provide a surface of the specified metal or metal alloy. The sheath or outer specified metal or specified metal alloy surface can be plated (e.g. by electroplating or electroless plating) on the base member, placed upon the base member as a sleeve, welded on the base member as a plate, flame sprayed on the base member, co-extruded around a core, and the like. The specified metal or metal alloy is preferably of a sufficient thickness to prevent migration of the metal of the base member to the working surface, for example sufficiently thick to prevent copper migration to the surface of the gold when a copper core is plated with gold. Generally, this may encompass a thickness of at least about 0.0013 cm. (0.0003 inch). Preferred thickness are about 0.0013cm. (0.005 in.). Of course, expense dictates the upper limit of the gold or gold alloy, platinum group metal or platinum group metal alloy thickness, it being within the scope of this invention to provide a fuser member made completely of the specified metal or metal alloy. In a preferred embodiment a coating of nickel, for example about 0.1 mil (0.0003 cm) or thicker is applied to the copper core prior to the deposit of the specified metal or metal alloy thereon to prevent copper migration to the surface of the specified metal or metal alloy.

The gold alloys or platinum group metal alloys which may be used in accordance with the present invention, are those which retard degradation of the polymeric release fluids having functional groups especially at elevated temperatures ranging from about 100° F. to about 450° F. By degradation is meant loss of functional concentration due to catalyzed oxidation; crosslinking, increase of molecular weight and viscosity which cause materials handling problems; and ultimately gelation, and specified metal alloys which do not cause or promote, but which actually retard, the degradation of the polymeric release fluid having functional groups, are encompassed by the present invention. It has been found according to this invention that gold, rhodium and other platinum group metals are considerably less catalytically active toward the degradation of the release fluids, however, they perform the release function as well as copper. Gold and rhodium fuser roll surfaces show remarkable retarding of degradation of the polymeric release fluids having functional groups as compared with copper surfaces. Alternatively stated, the polymeric release fluids have unexpectedly high stability when the fuser member has a gold or rhodium surface as compared with a copper surface. Gold alloys and platinum group metal alloys as well as platinum group metals also show this unexpected improvement in stability of the release fluids having fucntional groups. All gold alloys, platinum group metals and platinum group metal alloys have not been tested for this unexpected result, however, simple tests carried out in accordance with Example I can easily prove the effectiveness of the particular specified metal or metal alloy without undue experimentation, and any metal or metal alloy which when used in conjunction with the polymeric release fluids having functional groups in accordance with the present invention, release toner images from heated fuser members without causing fluid degradation (gelation) in one or more 24 hour standby periods at about 100° F. to about 450° F. or higher, may be used in accordance with the present invention.

Alloys having 50% or more gold or platinum group metal are preferred, however, alloys having less than 50% of the specified metal alloy content are deemed to be within the scope of the present invention as long as they meet the criteria described above. Exemplary of gold alloys are gold/platinum; gold/cobalt; gold/-chromium; gold/iron; and the like. Examples of gold alloys are set forth and described in Vloume 10, Kirk-Othmer *Encyclopedia of Chemical Technology* John Wiley & Sons, Inc. 1968.

The platinum group metals, ruthenium, rhodium, palladium, osmium, iridium, and platinum and their preferred alloys are described in Volume 15, Kirk-Othmer *Encyclopedia of Chemical Technology,* John Wiley & Sons, Inc., 1968. Examples of these alloys include platinum/iridium; platinum/nickel, rhodium/-platinum; iridium/platinum; platinum/tungsten; ruthenium/platinum; platinum/cobalt; gold/palladium; silver/palladium; ruthenium/palladium; rhodium-/iridium; rhodium/ruthenium; osminium/platinum and the like.

The following examples further define and describe compare bare gold and rhodium surfaces on heated fuser members in an electrostatic reproducing apparatus using polymeric release materials having reactive functionality as release agents, for example mercapto-functional polysiloxanes and blends thereof to reduce toner offset on the fuser member surface. Parts and percentages are by weight unless otherwise indicated. The examples are intended to illustrate the various preferred embodiments of the present invention.

Testing of bare metal rolls was carried out in a device similar to the fuser assembly shown in FIG. 1. Unless otherwise indicated, the fusing fixture had 2" outside diameter rolls with a mercapto-functional polydimethylsiloxane fluid confined in a 5 ml. sump. The backup roll had an outside diameter of about 2,0 inches with a 0.1 inch layer of silicone rubber coated with 0.20 inches of fluorinated ethylene propylene resin. The gold coated fuser rolls had 0.0005 inch electroplated gold surfaces upon copper cores. Copper fuser rolls were non-plated copper cores.

A copper core fuser roll was electroplated by a conventional technique. One half of the roll (from end to center) was plated with 0.002 inch (0.0005 cm.) of gold and the other half was plated with 0.0002 inch (0.0005 cm.) rhodium. The plated roll was placed in a fuser assembly similar to that of FIG. 1 and a mercapto-functional polysiloxane release fluid was continuously applied therto. After about 500 copies were fused with the fuser assembly, blank paper was passed through the fuser assembly. No toner offset was observed for either half of the roll.

In accordance with the stated objects, bare gold and rhodium fuser members for pressure fixing toner electrostatic images at elevated temperatures wherein the fuser member has an improved release surface when used with polymer release fluids having functional groups, have been demonstrated. Gold alloys, platinum group metals or platinum group metal alloys are also contemplated for this type of fuser system.

While the invention has been described with respect to preferred embodiments, it will be apparent that certain modifications and changes can be made without departing from the spirit and scope of the invention and therefore, it is intended that the foregoing disclosure be limited only by the claims appended hereto.

What is claimed is:

1. In the method of fusing electroscopic thermoplastic resin toner images to a substrate including the steps of:

(a) forming a fluid film on a heated fuser member in an electrostatic reproducing apparatus, said film being a barrier to the electroscopic thermoplastic resin toner and comprising the product resulting from the interaction of the fuser member and a polysiloxane release fluid having mercapto-functional groups which interact with the fuser member, said polysiloxane being fluid at the temperature of the fuser member and acting as a release fluid film for the toner;

(b) contacting the toner image on the substrate with the coated, heated fuser member for a period of time sufficient to soften the electroscopic thermoplastic resin toner; and (c) allowing the toner to cool, the improvement comprising providing a fuser member having a gold or gold alloy surface to which said polysiloxane release fluid having mercapto-functional groups is applied.

2. The method of claim 1 wherein the mercapto-functional polysiloxane release fluid is a blend of mercapto-functional polysiloxane and at least one silution agent which is miscible therewith.

3. The method of claim 1 wherein the fuser member has a gold or gold alloy plated surface.

4. The method of claim 3 wherein the fuser member is a copper plated with gold or gold alloy.

5. A fuser member for pressure fusing electrostatic toner images at elevated temperatures comprising a base member having a bare metal working surface of gold or gold alloy; a polysiloxane release fluid layer on the gold or gold alloy surface, the polysiloxane release fluid having mercapto-functional groups; and a stable barrier layer intermediate the polysiloxane release fluid having mercapto-functional groups and the gold or gold alloy surface, the stable barrier layer comprising the chemical product resulting from the interaction of the polysiloxane release fluid having mercapto-functional groups and the gold or gold alloy.

6. The fuser member of claim 5 wherein the base member is copper.

7. The fuser member of claim 5 wherein the base member is a roll.

8. The member of claim 5 wherein the mercapto-functional polysiloxane release fluid is a blend of mercapto-functional polysiloxane and at least one dilution agent which is miscible therewith.

9. The fuser member of claim 5 wherein the gold alloy is gold/palladium.

10. The fuser member of claim 5 wherein the working surface of gold or gold alloy is plated upon the base member.

11. The fuser member of claim 5 wherein the gold or gold alloy is about 0.001 cm. to about 1.0 cm. in thickness.

12. Apparatus for contact fusing toner particles to a substrate, said apparatus comprising:

a heated structure comprising a rigid core, a layer of gold or gold alloy coated on the core, and a coating of a polysiloxane release material on said core, said polysiloxane release material having mercapto-functional groups which are capable of reacting with the gold or gold alloy, the coating of polysiloxane release material comprising a first barrier coating portion in contact with the gold or gold alloy, the first portion being formed during operation of the apparatus at the interface of the gold or gold alloy and the polysiloxane release material, the first portion having a greater affinity for the gold or gold alloy coating than the toner particles and thereby preventing toner particles from contacting the gold or gold alloy coating, and a second replenishing release portion, the release portion being the polysiloxane release material and having a cohesive force which is less than the adhesive forces between the toner particles and the substrate and the cohesive forces of the toner particles; and a backup member cooperating with said heated structure to form a nip to apply pressure to the substrate, the toner particles on the substrate contacting the heated structure.

13. Apparatus according to claim 12 wherein the polysiloxane release material is continuously applied.

14. Apparatus according to claim 12 wherein the polysiloxane release layer is intermittently applied.

15. Apparatus according to claim 12 wherein the heated structure is a roll.

16. In the method of fusing electroscopic thermoplastic resin toner images to a substrate including the steps of:

(a) forming a fluid film on a heated fuser member in an electrostatic reproducing apparatus, said film being a barrier to the electroscopic thermoplastic resin toner and comprising the product resulting from the interaction of the fuser member and a polysiloxane release fluid having mecapto-functional groups which interact with the fuser member, said polysiloxane being fluid at the temperature of the fuser member and acting as a release fluid film for the toner;

(b) contacting the toner image on the substrate with the coated, heated fuser member for a period of time sufficient to soften the electroscopic thermoplastic resin toner; and (c) allowing the toner to cool, the improvement comprising providing a fuser member having a platinum group metal or platinum group metal alloy surface to which said polysiloxane release fluid having mercapto-functional groups is applied.

17. The method of claim 16 wherein the mercapto-functional polysiloxane release fluid is a blend of mercapto-functional polysiloxane and at least one dilution agent which is miscible therewith.

18. The method of claim 16 wherein the fuser member has a platinum group metal or platinum group metal alloy plated surface.

19. The method of claim 18 wherein the fuser member is a copper roll plated with a platinum group metal or a platinum group metal or alloy.

20. The method of claim 16 wherein the platinum group metal is selected from the group consisting of ruthenuim, rhodium, palladium, osmium, iridium and platinum and the platinum group metal alloy is selected from the group consisting of ruthenium alloy, rhodium alloy, palladium alloy, osmium alloy, iridium alloy and platinum alloy.

21. A fuser member for pressure fusing electrostatic toner images at elevated temperatures comprising a base member having a bare metal working surface of a platinum group metal or a platinum group metal alloy; a polysiloxane release fluid layer on the platinum group metal or platinum group metal alloy surface, the polysiloxane release fluid having mercapto-functional groups; and a stable barrier layer intermediate the polysiloxane release fluid having mercapto-functional groups and the platinum group metal or platinum group metal alloy surface, the stable barrier layer comprising the chemical product resulting from the interaction of the polysiloxane release fluid having mercapto-functional groups and the platinum group metal or platinum group metal alloy.

22. The fuser member of claim 21 wherein the base member is copper.

23. The fuser member of claim 21 wherein the base member is a roll.

24. The fuser member of claim 21 wherein the mercapto-functional polysiloxane release fluid is a blend of mercapto-functional polysiloxane and at least one dilution agent which is miscible therewith.

25. The fuser member of claim 21 wherein the platinum group metal is selected from the group consisting of ruthenium, rhodium, palladium, osmium, iridium and platinum and the platinum group metal alloy is selected from the group consisting of ruthenium alloy, rhodium alloy, palladium alloy, osmium alloy, iridium alloy and platinum alloy.

26. The fuser member of claim 21 wherein the working surface of platinum group metal or platinum group metal alloy is plated upon the base member.

27. The fuser member of claim 21 wherein the platinum group metal or platinum group metal alloy is about 0.001 cm. to about 1.0 cm. in thickness.

28. Apparatus for contact fusing toner particles to a substrate, said apparatus comprising:

a heated structure comprising a rigid core, a layer of platinum group metal or platinum group metal alloy coated on the core, and a coating of a polysiloxane release material on said core, said polysiloxane release material being a mercapto-functional polysiloxane which is capable of reacting with the platinum group metal alloy, the first portion being formed during operation of the apparatus at the interface of the platinum group metal or platinum group metal alloy and the polysiloxane release material, the first portion having a greater affinity for the platinum group metal or platinum group metal alloy coating that the toner particles and thereby preventing toner particles from contacting the platinum group metal or platinum group metal alloy coating, and a second replenishing release portion the release portion being the polysiloxane release material and having a cohesive force which is less than the adhesive forces between the toner particles and the substrate and the cohesive forces of the toner particles; and a backup member cooperating with said heated structure to form a nip to apply pressure to the substrate, the toner particles on the substrate contacting the heated structure.

29. Apparatus according to claim 28 wherein the polysiloxane release material is continuously applied.

30. Apparatus according to claim 28 wherein the polysiloxane release layer is intermittently applied.

31. Apparatus according to claim 28 wherein the heated structure is a roll.

32. Apparatus according to claim 28 wherein the metal is ruthenium or ruthenium alloy.

33. Apparatus according to claim 28 wherein the metal is rhodium or rhodium alloy.

34. Apparatus according to claim 28 wherein the metal is palladium or palladium alloy.

35. Apparatus according to claim 28 wherein the metal is osmium or osimun alloy.

36. Apparatus according to claim 28 wherein the metal is iridium or iridium alloy.

37. Apparatus according to claim 28 wherein the metal is platinum or platinum alloy.

* * * * *